US008517719B2

(12) United States Patent
Briggs, Jr.

(10) Patent No.: US 8,517,719 B2
(45) Date of Patent: Aug. 27, 2013

(54) SWIRL BLOCK REGISTER DESIGN FOR WALL FIRED BURNERS

(75) Inventor: Oliver G. Briggs, Jr., Jefferson, MA (US)

(73) Assignee: ALSTOM Technology Ltd, Baden (CH)

( * ) Notice: Subject to any disclaimer, the term of this patent is extended or adjusted under 35 U.S.C. 154(b) by 514 days.

(21) Appl. No.: 12/394,612

(22) Filed: Feb. 27, 2009

(65) Prior Publication Data

US 2010/0221673 A1 Sep. 2, 2010

(51) Int. Cl.
*F23M 9/00* (2006.01)

(52) U.S. Cl.
USPC ..... 431/184; 431/182; 431/183; 431/185; 431/9; 60/748

(58) Field of Classification Search
USPC ..... 431/9, 166, 167, 168, 182, 183, 184, 431/185
See application file for complete search history.

(56) References Cited

U.S. PATENT DOCUMENTS

| | | | | | |
|---|---|---|---|---|---|
| 1,449,840 | A * | 3/1923 | Reid | 431/183 |
| 1,527,214 | A * | 2/1925 | Peabody | 431/184 |
| 1,648,937 | A * | 11/1927 | Dickerson | 159/4.1 |
| 1,885,067 | A * | 10/1932 | Woodeson | 110/104 R |
| 1,943,083 | A * | 1/1934 | McDonald et al. | 431/183 |
| 2,108,621 | A * | 2/1938 | Straitz | 431/184 |
| 2,144,098 | A * | 1/1939 | Baker | 431/184 |
| 2,320,576 | A * | 6/1943 | Dunn | 239/402 |
| 2,439,554 | A * | 4/1948 | Anderson | 431/184 |
| 2,800,888 | A * | 7/1957 | Miller et al. | 122/479.1 |
| 2,823,889 | A * | 2/1958 | Stalker | 416/214 R |
| 2,838,103 | A * | 6/1958 | Voorheis | 431/176 |
| 2,869,625 | A * | 1/1959 | Hogberg et al. | 137/601.08 |
| 2,889,871 | A * | 6/1959 | Voorheis | 431/9 |
| 3,145,670 | A * | 8/1964 | Copian et al. | 431/184 |
| 3,244,220 | A * | 4/1966 | Kloecker | 431/167 |
| 3,932,110 | A * | 1/1976 | Waddell | 431/184 |
| 4,155,701 | A * | 5/1979 | Primas | 431/183 |
| 4,203,718 | A * | 5/1980 | Tracy | 431/188 |
| 4,604,052 | A * | 8/1986 | Brown et al. | 431/168 |
| 4,681,532 | A * | 7/1987 | Chung | 431/183 |
| 4,927,352 | A * | 5/1990 | Chung | 431/184 |
| 5,415,114 | A * | 5/1995 | Monro et al. | 110/347 |
| 5,806,443 | A * | 9/1998 | Kobayashi et al. | 110/262 |
| 2005/0147492 | A1 * | 7/2005 | Mahoney et al. | 415/148 |
| 2009/0025395 | A1 * | 1/2009 | Nilsson et al. | 60/748 |
| 2009/0272117 | A1 * | 11/2009 | Wilbraham | 60/748 |
| 2009/0277179 | A1 * | 11/2009 | Wilbraham | 60/748 |
| 2009/0301092 | A1 * | 12/2009 | Wilbraham | 60/748 |
| 2009/0320485 | A1 * | 12/2009 | Wilbraham | 60/748 |
| 2010/0107644 | A1 * | 5/2010 | Wilbraham | 60/748 |
| 2010/0175381 | A1 * | 7/2010 | Wilbraham | 60/737 |
| 2010/0223932 | A1 * | 9/2010 | Wilbraham | 60/772 |

* cited by examiner

*Primary Examiner* — Kenneth Rinehart
*Assistant Examiner* — Jorge Pereiro
(74) *Attorney, Agent, or Firm* — James J. Cummings

(57) ABSTRACT

A simple, economical and reliable swirl register [1000] is described for use with a wall burner of a commercial boiler. It employs a number of spaced swirl blocks [1150] that connect side plates [1110, 1120]. A number of moveable vanes [1130] are provided in the air ducts [1155] created between the swirl blocks [1150]. The vanes [1130] are attached to vane rods [1160] that operate the vanes [1130]. The swirl blocks [1150] are lightweight and rigid structures for holding the side plate [1110] a fixed distance from side plate [1120]. The block construction reduces binding of the vanes [1130] as the swirl register [1000] receives differential heating. The vane rods [1160] extend through a windbox front plate [1250] outside of the windbox area. A linkage assembly [1200] rotates the vane rods [1160]. A motor and gearbox [1230] cause all vanes [1130] to rotate the same amount.

15 Claims, 5 Drawing Sheets

SWIRL BLOCK REGISTER DESIGN FOR WALL FIRED BURNERS

TECHNICAL FIELD

The present disclosure relates registers for furnaces that burn pulverized coal and more specifically to swirl registers for wall burners of furnaces that burn pulverized coal.

BACKGROUND

Current coal fired boilers employ burners located in the furnace wall ("wall burners") to burn pulverized coal. These typically are used to make steam for generation of electricity.

Generally, pulverized coal is suspended in an air stream and blown into a boiler's furnace for burning. Air is introduced into the combustion chamber through registers along with the pulverized coal in a swirled fashion around a core of the pulverized coal stream. This provides more efficient burning and control over NO, emissions.

Combustion air is provided to the registers through an air conduit referred to as a 'windbox'. The air passes from the windbox through the registers into the combustion chamber.

Some registers employ vanes that direct the incoming stream of air into a helical shape. The fuel stream passes longitudinally through the center of the burner and mixes with the swirling air from the register. The vanes may be moveable to adjust the swirl of air entering the register. The position of the vanes changes the ratio of axial airflow to tangential airflow.

These different flow patterns determine the shape and length of the flame produced and allow the proportion of the air's axial and tangential component to change the shape of the flame. The proper flame shape reduces flame quenching when it contacts the far boiler wall.

Therefore, it is important to be able to adjust the vanes to provide more efficient combustion.

In the prior art designs the linkage mechanism that controls the position of the vanes was located in the windbox. Typically, this is acceptable. However, when certain regenerative air heaters are used, exhaust gas impurities, such as flyash is transferred from the exiting flue gas into the windbox. Since the mechanism to rotate the vanes is also in the windbox, the accumulation of these impurities causes clogging and failure of the vane motion mechanism.

Prior art designs have the vanes on pivots between two parallel plates. The plate and vane closer to the combustion chamber experiences a higher temperature. The plate further from the combustion chamber experiences a lower temperature. The temperature differential causes differential expansion of the parts and structure. This variable expansion causes binding of the vanes between the plates. This binding prohibits the motion of the vanes, and leads to inefficient operation.

Since different vanes and different number of vanes may bind at different times, it introduces mechanical and reliability problems.

What further complicates the situation is that the mechanism that operates the motion of the vanes is typically located within the windbox. Its location is difficult to access for maintenance. It may require shutting down the boiler and may also require disassembly to access the windbox to adjust or repair the mechanism.

Currently, there is a need for an efficient burner for a furnace that is simple, inexpensive and more reliable than current designs.

SUMMARY

The present invention may be embodied as a swirl register [1000] for use in a furnace with a windbox comprising:

a first side plate [1110] being generally flat;

a second side plate [1120] being generally flat;

a plurality of swirl blocks [1150] spaced apart from each other connected between the side plates [1110, 1120] so as to cause the side plates [1110, 1120] to be fixed generally parallel to each other, and to create a plurality of air ducts [1155] between the swirl blocks [1150];

a plurality of vane rods [1160] each having a first end and a second end, the vane rods [1160] extending generally perpendicularly through the second side plate [1120];

a plurality of vanes [1130] each attached to the first end of each vane rod [1160] and positioned within the air ducts [1155], such that the vanes [1130] are allowed to move between a closed position in which the vanes [1130] close the air ducts [1155] and at least one open position in which the ducts [1155] are at least partially open when the vane rods [1160] are rotated.

OBJECTS OF THE INVENTION

It is an object of the present invention to provide a simple and economical wall burner swirl register.

It is another object of the present invention to provide a more reliable wall burner swirl register than current designs.

It is another object of the present invention to provide a wall burner swirl register that employs vanes that exhibit less binding than conventional swirl registers.

It is another object of the present invention to provide a wall burner swirl register that employs a more reliable vane movement mechanism.

It is an object of the present invention to provide a wall burner swirl register that withstands large temperature differentials without failure.

It is an object of the present invention to provide a wall burner swirl register that is more accessible and easier to maintain.

BRIEF DESCRIPTION OF THE DRAWINGS

Referring now to the drawings, wherein like items are numbered alike in the various Figures.

DETAILED DESCRIPTION

A new swirl register design has been developed which provides for a reliable, rigid, yet lightweight device.

This swirl register includes pivoting vanes that, depending upon their position, provides a full range of swirl directions from full axial flow to full tangential flow. The swirl register also is adjustable to stop airflow, as required in a burner shut off position.

Figure 1:
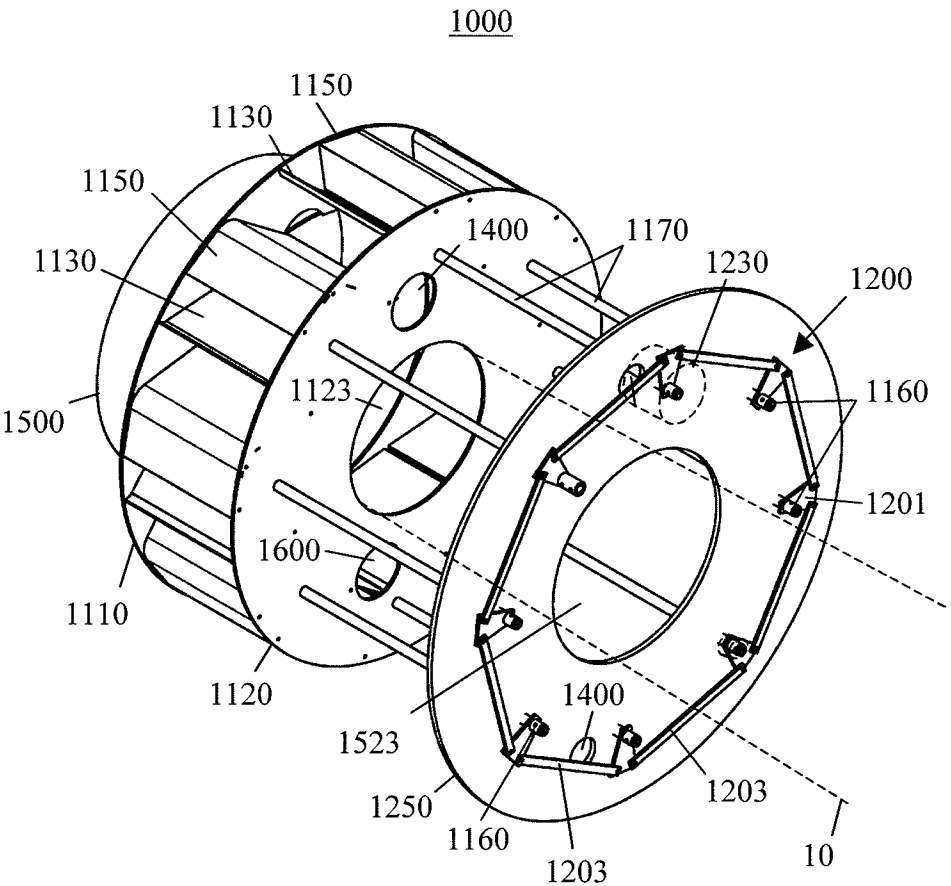
FIG. 1 is a front perspective view of a swirl register for a pulverized solid fuel burner according to the present invention.
Figure 2:
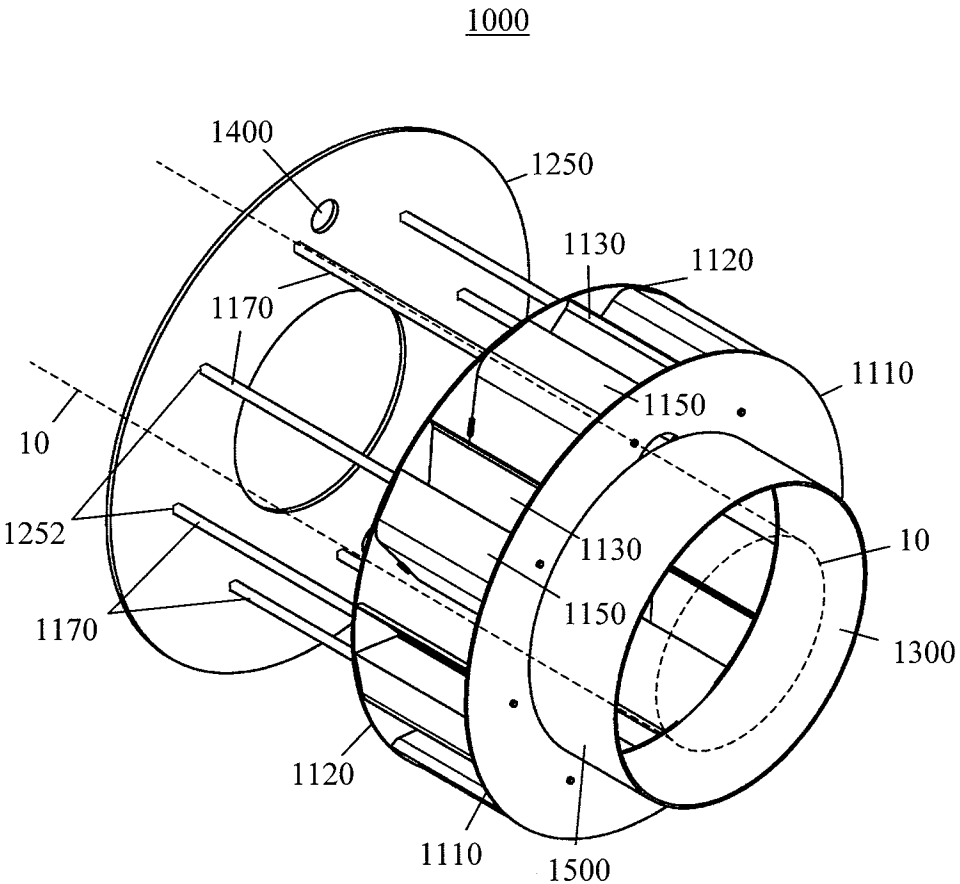
FIG. 2 is a rear perspective view of the swirl register of FIG. 1.

FIG. 1 is a front perspective view of a swirl register 1000 for a burner for pulverized solid fuel according to the present invention. FIG. 2 is a rear perspective view of the swirl register 1000 of FIG. 1. This embodiment will be described with reference to FIGS. 1 and 2.

The swirl register 1000 consists of two parallel side plates 1110, 1120 separated and joined together by a series of swirl blocks 1150. These swirl blocks 1150 are attached between the side plates 1110, 1120 to provide a lightweight and rigid structure.

This rigid structure resists twisting and flexing under variable heating conditions which have caused problems in prior art registers.

The swirl blocks 1150 each have an angled side, or are positioned to have angled sides to create angled air ducts 1155 between them. The angled air ducts 1155 direct air radially inward as well as tangentially around a circumferential path within the swirl register 1000. The angled air ducts 1155 cause swirling of the secondary air prior to mixing it with the fuel stream.

A plurality of vanes 1130 is provided in each of the air ducts 1155. These function to allow the air ducts 1155 to remain fully open, partially opened or fully closed. In the fully closed position, air is prevented from flowing though the air ducts 1155 of swirl register 1000, shutting off the burner when it is not in service.

Each vane 1130 is attached to a vane rod 1160 that rotates its respective vane 1130 to adjust the opening of its respective air duct 1155. The vane rods 1160 each extend through side plate 1120, support tube 1170 located in the windbox and through a windbox front plate 1250. A linkage assembly 1200 is located on the windbox front plate 1250.

Linkage assembly 1200 links to and rotates vane rods 1160. The vane rods 1160 are linked together with linkage assembly 1200 so that they can be operated in unison from the windbox front plate 1250. Linkage assembly 1200 employs a gearbox 1230 that actuates a drive link 1201. Drive link 1201 is pivotally connected to a tangential link 1203 that is pivotally connected to another drive link 1201 causing it to rotate the vane rod 1160 to which it is connected.

Since linkage assembly 1200 is mounted on the windbox front plate 1250 on the side facing away from the side plates 1110, 1120, and outside of the windbox, it is readily accessible without the need to disassemble the windbox or shut down the furnace. All of the operating mechanisms are located external to the windbox. This provides easy access to a linkage assembly 1200 that pivots the vanes 1130.

Figure 3:
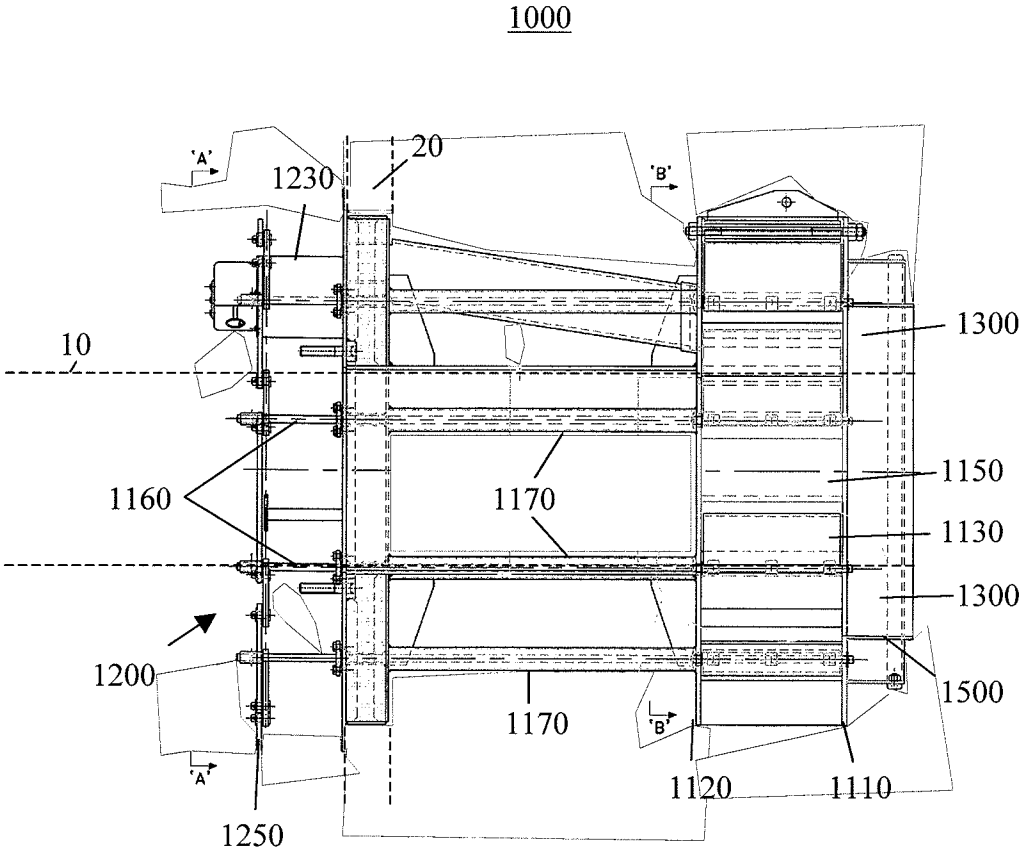
FIG. 3 is a side elevational view of another embodiment of the swirl register.

FIG. 3 is a side elevational view of another embodiment of the swirl register. This embodiment shares many of the same structures and functions of that of FIGS. 1 and 2, however this shows the embodiment employed in a functioning burner. The main difference is that the access holes are in different locations.

In this view it can be seen that windbox front plate 1250 secures to the outside of a windbox wall 20. A plurality of support tubes hold side plate 1120 a fixed distance from windbox wall 20. Rods 1160 pass through holes in windbox front plate 1250 through the windbox wall 20 through the support tubes 1170, through side plate 1120 to attach to vanes 1130. Vanes 1130 are positioned between side plates 1120 and 1110. An extension lip 1500 extends out of the windbox and into a burner.

Fuel tube 10, that typically carries pulverized coal particles suspended in airflow, passes through the length of the swirl register. Secondary air passes between the swirl blocks 1150 and into the center of swirl register 1000. This swirling flow exits through secondary air annulus 1300.

The linkage assembly 1200 shown here from the side is driven by a gearbox 1230. Gearbox 1230 increases the mechanical advantage to provide a smooth motion of linkage assembly 1200. There is a position indicator (1235 of FIG. 5) that visually indicates the position of the vanes 1130 for operation and maintenance purposes.

Figure 4:
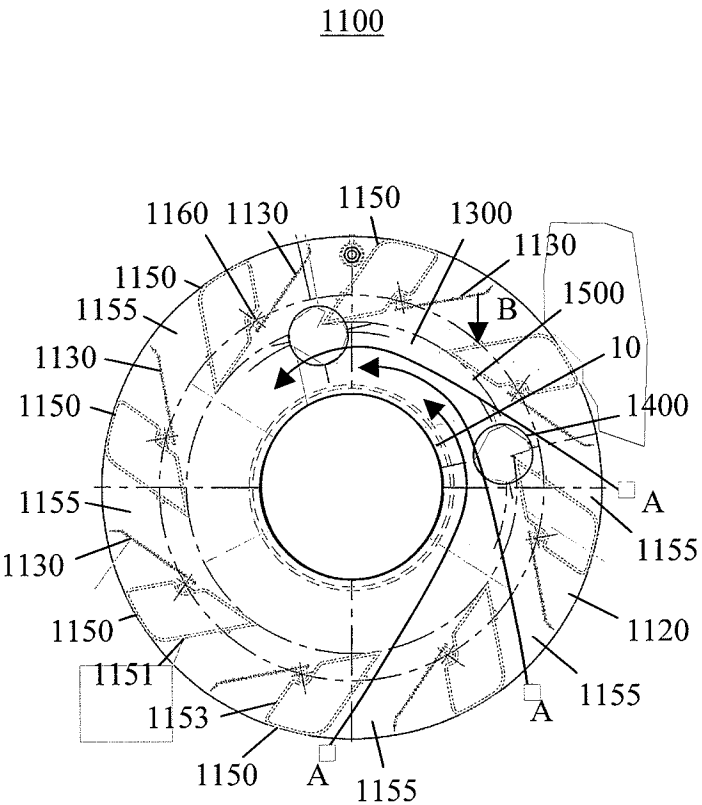
FIG. 4 is a cross sectional view of swirl register of FIG. 3 along lines "B-B"

FIG. 4 is a cross sectional view of swirl register of FIG. 3 along lines "B-B" showing air duct assembly 1100. In this view, swirl blocks 1150 are shown in phantom since they are on the other side of side plate 1120. The construction using swirl blocks 1150 results in a rigid structure.

Here it can be seen that two adjacent swirl blocks 1150 each have a block wall 1151, 1153 that face each other. They are spaced apart to create an air duct 1155 between them. At least one of the block walls 1151, 1153 should be angled with respect to a radial direction from the center of side plate 1120 to create the rotation of the incoming airflow. In this case the block wall 1151 is angled.

The vanes 1130 are shown here in a partially opened position allowing secondary air to enter through ducts 1155 as indicated by the arrows marked "A". The angle and geometry cause the air to spiral around fuel flow tube 10.

As the vane rods 1160 are rotated (clockwise from this view) vanes 1130 move in the direction of arrow marked "B" to partially, or fully close air ducts 1155.

When vane 1130 is rotated counter clockwise to touch swirl block 1150, it is in the axial position. The position of vane 1130 shown here is its full tangential flow position. Rotating it clockwise closes off airflow.

When the vanes 1130 are fully open, they create the lowest ratio of swirling to axial flow. When the vanes 1130 are moved toward a closed position, they reduce the airflow. The swirl register of the present invention functions to adjust combustion and shape the flame produced by its associated burner.

When closed, the air ducts 1155 shut off air flowing to its associated burner. This is important when a furnace with multiple burners is using less than all burners.

Figure 5:
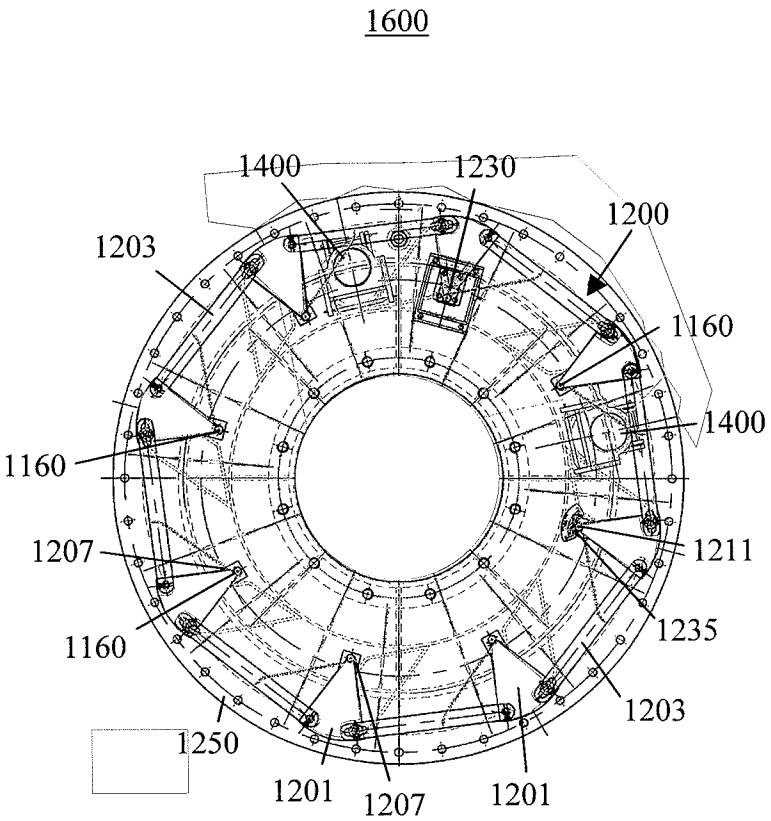
FIG. 5 is a cross sectional view of swirl register of FIG. 3 along lines "A-A".

FIG. 5 is a cross sectional view of swirl register of FIG. 3 along lines "A-A" showing a vane control mechanism 1600. In this view, the parts of the linkage assembly 1200 are visible. A gearbox 1230 drives the linkage assembly 1200. These causes drive link 1201 to move. The drive links 1201 are also connected to tangential links 1203. As the drive links 1201 pivot about the vane rod 1160, they move the tangential links 1203 in a direction abound the perimeter of windbox plate 1250. Since the other side of each tangential link 1203 is then connected to another drive link 1201, making a circular linkage pattern. This linkage assembly 1200 insures that all vane rods 1160 rotate simultaneously by the same amount, and are in the same relative position with each of the air ducts 1155. A visual position indicator 1235 shows the position of the vanes 1130. This may also be supplemented with electronic sensors that monitor the position of the vanes 1130 and provide that information to a user control panel.

The vane rods 1160 pass through the windbox plate 1250 through a plurality of holes in windbox plate 1250. Each of these have a seal in a small box structure called a rod box seal 1207. These hold the vane rods 1160, allow them to rotate and prevent significant leakage of hot gasses from the windbox.

Therefore, the swirl register 1000 according to the present invention is a rigid, lightweight design that keeps the operating mechanisms properly aligned, throughout the range of operation.

The present invention allows for the full tangential or full axial flow. In addition, the user may select other ratios of tangential to axial flow. The present invention can be placed in a closed position to stop airflow to a burner when it is not in use.

Unlike conventional registers, the swirl register of the present invention has the advantage of maintaining a consistent inlet opening for various vane positions thus keeping the air pressure drop through the register substantially constant.

Operating linkage and drive are located external to the windbox providing for easier inspection and maintenance. It also provides increased reliability.

The design allows for a full range of secondary air swirl control from full axial to tangential flow. It also incorporated a shutoff position of the vane within the air duct for burner airflow shut off or biasing.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A swirl register [1000] for use in a furnace with a windbox comprising:

a first side plate [1110] being generally flat;

a second side plate [1120] being generally flat;

a plurality of swirl blocks [1150] having at least four walls enclosing a space, the swirl blocks [1150] spaced apart from each other and connected between the side plates [1110, 1120] so as to cause the side plates [1110, 1120] to be fixed generally parallel to each other, and to create a plurality of air ducts [1155] between the swirl blocks [1150];

a plurality of vane rods [1160] each having a first end and a second end, the first end of the vane rods [1160] extending generally perpendicularly through the second side plate [1120]; and a plurality of vanes [1130] each attached to the first end of each vane rod [1160] and positioned within the air ducts [1155], such that the vanes [1130] are allowed to move between a closed position in which the vanes [1130] close the air ducts [1155] and at least one open position in which the air ducts [1155] are at least partially open when the vane rods [1160] are rotated.

2. The swirl register [1000] of claim 1 further comprising:

a linkage assembly [1200] having a plurality of drive links [1201], each drive link [1201] pivotally connected to one of the vane rods [1160] at their second end, the linkage assembly [1200] also having a plurality of tangential links [1203], each tangential link [1203] pivotally connected to at least one of the drive links [1201] such that motion of the linkage assembly [1200] causes rotation of all the attached vane rods [1160]; and a drive source coupled to the linkage assembly [1200] causing motion of the linkage assembly [1200] and rotation of all attached vane rods [1160].

3. The swirl register [1000] of claim 2 wherein:

the linkage assembly [1200] and drive source are attached to the windbox front plate [1250].

4. The swirl register [1000] of claim 1 wherein the swirl register [1000] passes through said windbox of said furnace, further comprising:

a windbox front plate [1250] having a plurality of holes each adapted to receive a vane rod [1160] functioning to stabilize the vane rods [1160] while allowing them to rotate.

5. The swirl register [1000] of claim 4 wherein:

the vane rods [1160] extend through the windbox and the windbox front plate [1250] that is positioned outside of the windbox for providing easy access.

6. A method of providing a more reliable swirl register comprising the steps of:

providing a rigid air duct assembly [1100] having a plurality of swirl blocks [1150] each having at least four walls enclosing a space the swirl blocks [1150] spaced apart from each other creating a plurality of angled air ducts [1155] between the swirl blocks [1150];

providing a plurality of vanes [1130] inside of the air ducts [1155] adapted to adjust a rate of air flowing through the air ducts [1155] by selecting a position for the vanes [1130];

attaching a vane rod [1160] to each of the vanes [1130] to control their position remotely; and providing a vane control mechanism [1600] attached to the vane rods [1160] in an easily accessible and clean location for controlling the vane rods [1160] and positions of the vanes [1130].

7. The method of claim 6 wherein the step of providing a rigid air duct assembly [1100] further comprises the steps of:

providing a first side plate [1110] having a perimeter; and attaching the plurality of swirl blocks [1150] to the first side plate [1110] spaced from each other around the perimeter of the side plate [1110] to create a plurality of spaces between the swirl blocks angled with respect to a radial direction from a center of the side plate [1110], attaching a second side plate [1120] to the swirl blocks [1150] such that the first side plate [1110] and the second side plate [1120] are substantially parallel to each other, and the second side plate [1120] closes the angled spaces creating the angled air ducts [1155].

8. The method of claim 6 wherein the vane control mechanism [1600] is positioned outside of a windbox configured for passing a secondary air therethrough.

9. A reliable swirl register [1000] for receiving secondary air from a windbox of a furnace and providing the secondary air into a stream of air and pulverized solid fuel passing through a fuel tube [10] comprising:

a rigid air duct assembly comprising:

a first side plate [1110], a second side plate [1120], a plurality of swirl blocks [1150] having at least four walls enclosing a space, the swirl blocks [1150] spaced from each other and positioned to create angled air ducts [1155] between them, the swirl blocks [1150] connecting the first side plate [1110] substantially parallel to the second side plate [1120], such that the first side plate [1110] and the second side plate enclosed the plurality of air ducts [1155];

a plurality of vanes [1130] within the air ducts [1155] adapted to select an air flow rate through the air ducts [1155] based upon their position; and a vane control mechanism [1600] for accurately controlling the position of the vanes thereby defining the airflow rate through the air ducts [1155].

10. The reliable swirl register [1000] of claim 9 wherein the vane control mechanism [1600] is located outside of the windbox.

11. The reliable swirl register [1000] of claim 9 wherein the vane control mechanism [1600] comprises:

a plurality of vane rods [1160] each coupled to a vane [1130] and the vane rods [1160] are remotely actuated to adjust the position of the vanes [1130].

12. The reliable swirl register [1000] of claim 11 wherein the vane control rods [1160] are remotely operated from outside of the windbox.

13. The reliable swirl register [1000] of claim 11 further comprising:

a windbox plate [1250] attached to a windbox wall [20] for receiving and stabilizing the vane rods [1160].

14. The reliable swirl register [1000] of claim 9 wherein the vane control mechanism [1600] comprises:

a motor in a gearbox [1230] that together actuate the vane rods [1160].

15. The reliable swirl register [1000] of claim 9 wherein the swirl blocks [1150] are positioned to have at least two block walls [1151, 1153] adjacent to each other, wherein at least one block wall [1151, 1153] is angled with respect to a radial direction, the swirl blocks [1150] positioned such that the at least two adjacent block walls [1151, 1153], the first side plate [1110] and the second side plate [1120] create the angled air duct [1155].

* * * * *